US008936052B2

(12) United States Patent
Beisel

(10) Patent No.: US 8,936,052 B2
(45) Date of Patent: Jan. 20, 2015

(54) BEVERAGE BOTTLING PLANT FOR FILLING BOTTLES WITH A BEVERAGE, A CONTAINER FILLING PLANT FOR FILLING BOTTLES, CANS, BAGS, OR SIMILAR CONTAINERS WITH A LIQUID, AND A CONTAINER FILLING MACHINE FOR FILLING CONTAINERS IN A CONTAINER FILLING PLANT

(75) Inventor: Michael Beisel, Schöneberg (DE)

(73) Assignee: KHS GmbH (DE)

( * ) Notice: Subject to any disclaimer, the term of this patent is extended or adjusted under 35 U.S.C. 154(b) by 561 days.

(21) Appl. No.: 12/428,583

(22) Filed: Apr. 23, 2009

(65) Prior Publication Data

US 2010/0101183 A1 Apr. 29, 2010

Related U.S. Application Data

(63) Continuation-in-part of application No. PCT/EP2007/008958, filed on Oct. 16, 2007.

(30) Foreign Application Priority Data

Oct. 24, 2006 (DE) ..... 10 2006 049 963

(51) Int. Cl.
*B67B 3/22* (2006.01)
*B67C 3/22* (2006.01)

(52) U.S. Cl.
CPC ..... *B67C 3/22* (2013.01)
USPC ..... 141/144; 141/237

(58) Field of Classification Search
CPC ..... B67C 3/22
USPC ..... 53/272, 276, 282, 284.5, 284.6, 284.7; 134/166 R, 167 R; 141/144, 237
See application file for complete search history.

(56) References Cited

U.S. PATENT DOCUMENTS

| | | | | |
|---|---|---|---|---|
| 989,546 | A * | 4/1911 | Jensen | 141/117 |
| 1,058,096 | A * | 4/1913 | Phelps | 141/45 |
| 1,804,985 | A * | 5/1931 | Hoffman | 141/82 |
| 2,147,366 | A * | 2/1939 | Fagan et al. | 141/13 |
| 2,309,859 | A * | 2/1943 | Mojonnier et al. | 141/45 |

(Continued)

FOREIGN PATENT DOCUMENTS

| | | |
|---|---|---|
| CN | 2365500 Y | 2/2000 |
| DE | 21 59 498 | 6/1973 |

(Continued)

OTHER PUBLICATIONS

Foged et al.—Stainless steel in the food industry—An introduction—Jan. 10, 2005.*

(Continued)

*Primary Examiner* — Stephen F Gerrity
(74) *Attorney, Agent, or Firm* — Nils H. Ljungman & Associates

(57) ABSTRACT

A filling machine for the filling of containers with a liquid product, with a plurality of filling elements provided on a rotor or a rotor segment that can be driven in rotation around a vertical machine axis. The surfaces of the filling machine that come into contact with the liquid product between a product storage and a dispensing opening are made of a material which is of a higher grade, such as stainless steel, than the elements of the rotor or rotor segment that support the product bowl and the filling elements.

13 Claims, 3 Drawing Sheets

(56) References Cited

U.S. PATENT DOCUMENTS

| | | | | |
|---|---|---|---|---|
| 3,093,165 | A * | 6/1963 | Risser | 141/140 |
| 4,222,773 | A | 9/1980 | Degerbeck | |
| 4,559,961 | A | 12/1985 | Anderson et al. | |
| 5,501,253 | A * | 3/1996 | Weiss | 141/40 |
| 5,865,225 | A * | 2/1999 | Weiss | 141/198 |
| 5,960,838 | A * | 10/1999 | Tietz et al. | 141/89 |
| 6,026,867 | A * | 2/2000 | Klarl | 141/91 |
| 6,035,872 | A * | 3/2000 | Hees et al. | 134/167 R |
| 6,494,238 | B2 * | 12/2002 | Sindermann | 141/6 |
| 6,644,363 | B2 * | 11/2003 | Sogliani et al. | 141/83 |
| 7,104,033 | B2 * | 9/2006 | Krulitsch | 53/467 |
| 7,469,726 | B2 | 12/2008 | Clusserath et al. | |
| 8,100,152 | B2 * | 1/2012 | De Antoni Migliorati | 141/146 |
| 2002/0014276 | A1 * | 2/2002 | Clusserath | 141/40 |
| 2003/0075547 | A1 * | 4/2003 | Stocchi | 220/592.01 |
| 2005/0284537 | A1 * | 12/2005 | Hartness et al. | 141/144 |
| 2006/0245673 | A1 * | 11/2006 | Lupi | 383/119 |
| 2007/0023100 | A1 * | 2/2007 | Blichmann | 141/18 |
| 2008/0206088 | A1 * | 8/2008 | Cusolito et al. | 420/57 |
| 2008/0258034 | A1 * | 10/2008 | Zepf | 248/637 |

FOREIGN PATENT DOCUMENTS

| | | | |
|---|---|---|---|
| DE | 37 03 151 | A1 | 8/1988 |
| DE | 37 22 505 | | 1/1989 |
| JP | 4299968 | A | 10/1992 |
| JP | 11001295 | A | 1/1999 |
| JP | 11 277016 | A | 10/1999 |
| JP | 2001328696 | A | 11/2001 |
| SU | 983373 | A | 12/1982 |
| WO | WO 99/43553 | | 9/1999 |
| WO | WO 03/033755 | A1 | 4/2003 |
| WO | WO 03/088796 | A1 | 10/2003 |

OTHER PUBLICATIONS

International Search Report PCT/EP2007/008958 and English translation thereof.

International Preliminary Report on Patentability PCT/EP2007/008958 and English translation thereof.

* cited by examiner

FIG. 2
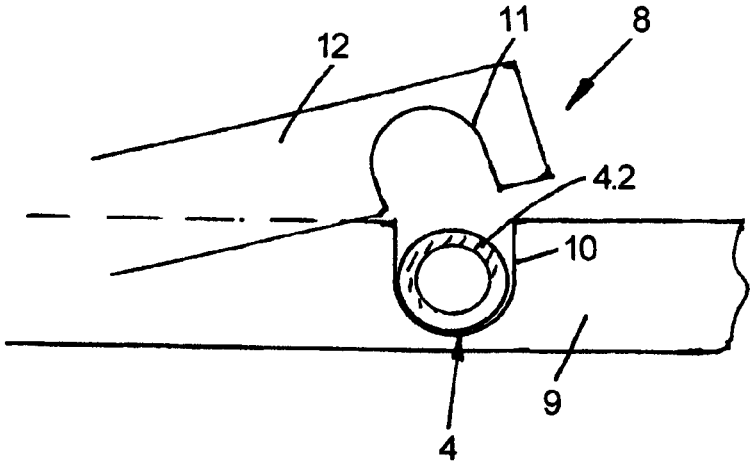
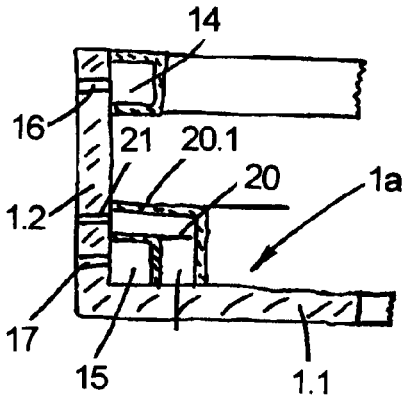
FIG. 3
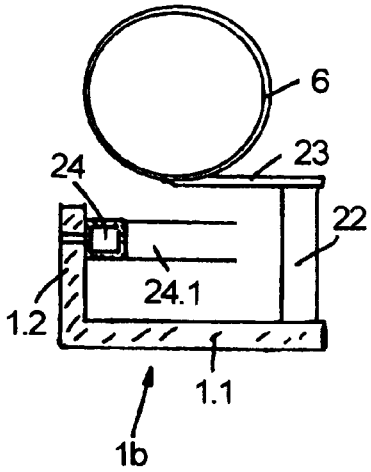
FIG. 4

BEVERAGE BOTTLING PLANT FOR FILLING BOTTLES WITH A BEVERAGE, A CONTAINER FILLING PLANT FOR FILLING BOTTLES, CANS, BAGS, OR SIMILAR CONTAINERS WITH A LIQUID, AND A CONTAINER FILLING MACHINE FOR FILLING CONTAINERS IN A CONTAINER FILLING PLANT

CONTINUING APPLICATION DATA

This application is a Continuation-In-Part application of International Patent Application No. PCT/EP2007/008958, filed on Oct. 16, 2007, which claims priority from Federal Republic of Germany Patent Application No. 10 2006 049 963.8, filed on Oct. 24, 2006, and from Federal Republic of Germany Patent Application No. 20 2006 016 208.9, filed on Oct. 24, 2006. International Patent Application No. PCT/EP2007/008958 was pending as of the filing date of this application. The United States was an elected state in International Patent Application No. PCT/EP2007/008958.

BACKGROUND

1. Technical Field

The present application relates to a beverage bottling plant for filling bottles with a beverage, a container filling plant for filling bottles, cans, bags, or similar containers with a liquid, and a container filling machine for filling containers in a container filling plant 2. Background Information Background information is for informational purposes only and does not necessarily admit that subsequently mentioned information and publications are prior art.

The present application relates to a filling machine for the filling of bottles, cans, bags or similar containers with a liquid pourable product, with a plurality of filling elements provided on a rotor or a rotor segment that can be driven in rotation around a vertical machine axis. Each filling element has a dispensing opening for the controlled dispensing of the pourable product into the container to be filled and is part of a pourable product path which is formed by the components that carry the pourable product, and which connects the respective dispensing opening with a pourable product bowl which is supported on the rotor or rotor segment with a support structure.

Filling machines, including those that employ a rotary construction, are known in a wide variety of different realizations.

According to the World Steel Association, formerly known as the International Iron and Steel Institute, there are currently more than 3,500 different grades of steel with many different physical, chemical, and environmental properties.

Pitting is a type of localized corrosion of metals and steels and stainless steels which leads to small holes forming in the metal. Pitting and other types of corrosion in the bottling field leads to contamination of beverages and similar liquids. To avoid, restrict, and/or minimize pitting and therefore avoid, restrict, and/or minimize contamination of the beverage or similar liquid, the surfaces of a filling machine which some in contact with that beverage or similar liquid should be made of a pitting-resistant or corrosion-resistant material.

OBJECT OR OBJECTS

An object of the present application is to create a filling machine with improved operation.

SUMMARY

The present application teaches that this object can be realized by a filling machine for the filling of bottles, cans, bags, or similar containers with liquid pourable product, with a plurality of filling elements provided on a rotor or a rotor segment that can be driven in rotation around a vertical machine axis. Each filling element has a dispensing opening for the controlled dispensing of the pourable product into the container to be filled and is part of a pourable product path which is formed by the components that carry the pourable product, and which connects the respective dispensing opening with a pourable product bowl which is provided on the rotor or rotor segment. The surfaces of the pourable product path that come into contact with the pourable product between the pourable product bowl and the dispensing opening are made of a material which is of a higher grade than the elements of the rotor or rotor segment that support the pourable product bowl and the filling elements. The present application also teaches that this object can be realized by a filling machine for the filling of bottles, cans, bags or similar containers with a liquid pourable product, with a plurality of filling elements provided on a rotor or a rotor segment that can be driven in rotation around a vertical machine axis. Each filling element has a dispensing opening for the controlled dispensing of the pourable product into the container to be filled and is part of a pourable product path which is formed by the components that carry the pourable product, and which connects the respective dispensing opening with a pourable product bowl which is supported on the rotor or rotor segment with a support structure. The support structure is formed by a plurality of support elements which are distributed around the machine axis and are essentially identical in terms of shape, volume and material.

According to one aspect of the present application, the surfaces that come into contact with the pourable product of each pourable product path that extends between the dispensing opening of the individual filling element and the pourable product bowl, and thereby the elements that form this pourable product path (which are called the "elements that carry the liquid" below) are made of a very high-grade material that is compatible with the liquid being packaged and in one possible embodiment a material that is resistant to both the liquid being packaged and the cleaning and/or sterilization agents that are used, in one possible embodiment of a material that has a high resistance to corrosion, for example a high-grade steel or stainless steel, e.g. in Class 1.4404 or 1.4571. For the manufacture in one possible embodiment of the section of the rotor or the rotor segment that carries the filling elements, the pourable product bowl and the other functional elements of the filling machine, on the other hand, a significantly more economical and commercial-grade steel in a "standard" grade or a grade that is lower than the material used for the elements that carry the liquid, for example a steel of Class 1.4301. For example, the gas and vacuum ducts realized on the rotor can also be manufactured from this material.

According to the Anodic Index of Galvanic Compatibility, stainless steels in Classes 1.4571, 1.4404, and 1.4301, which comprise about eighteen percent chromium, have the value of 0.50 Volts. Because these values are the same, galvanic corrosion (also known as bimetallic corrosion and dissimilar metal corrosion) should be minimized. Therefore, in at least one possible embodiment of the present application using stainless steels in Classes 1.4571, 1.4404, and 1.4301, minimal corrosion between the classes of stainless steels occurs on the filling machine of the present application.

In an embodiment of the present application in which the filling machine comprises two dissimilar materials, galvanic corrosion can be restricted or minimized by plating or finishing the two dissimilar materials. When plating is not present, or when the two metals are in contact with one another, the two metals which comprise the filling machine should be substantially identical or substantially similar in the electrochemical series.

According to another aspect of the present application, the pourable product bowl is held on the rotor by means of a support structure which is realized so that it reduces the shifting or displacement of the pourable bowl caused by variations in temperature, in one possible embodiment with respect to the rotor, in the form of a cage work or lightweight structure, and in one possible embodiment, for example, comprising a plurality of support elements having the smallest possible volume but identical or essentially identical in shape or volume and made from an identical or essentially identical material or steel, in one possible embodiment of a material that has a coefficient of thermal expansion that is as low as possible. In at least one possible embodiment, what are termed Invar materials can also be used, the essential or general characteristic of which is that Invar materials experience no variations in length in response to temperature variations within a defined temperature interval.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the present application are described according to the present application. The present application is explained in greater detail below on the basis of one possible embodiment which is illustrated in the accompanying figures, in which:

FIG. 2 shows a detail of a support element for the pourable product line;

FIG. 3 shows a section through the rotor segment and through a gas and/or vacuum duct realized on it in an additional possible embodiment of the present application;

FIG. 4 shows a detail of one of the support elements for the pourable product ring bowl in an additional possible embodiment of the present application.

DESCRIPTION OF EMBODIMENT OR EMBODIMENTS

Figure 1:
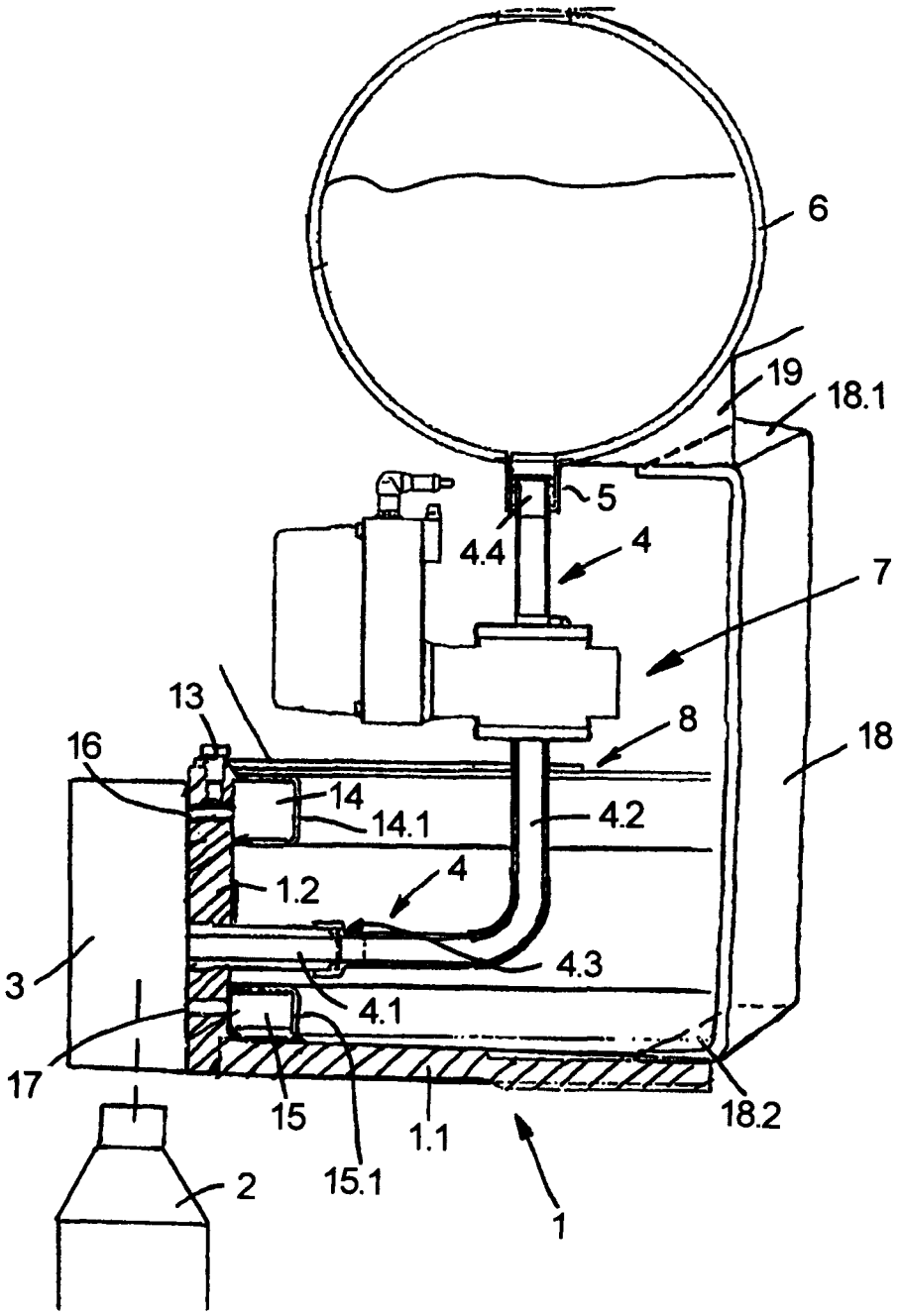
FIG. 1 is a simplified partial illustration and sectional view of a portion of a rotor (rotor segment) of a filling machine that employs a rotary construction, together with a filling element, with a ring-shaped pourable product bowl to hold the pourable product and with one of the connecting or pourable product lines between the pourable product bowl and the filling element.

In the figures, 1 is a ring-shaped rotor segment of a rotor, the rest of which is not shown, and which can be driven in rotation around a vertical machine axis, on a filling machine that employs a rotary construction for the filling of bottles 2 or similar containers with pourable product. In the illustrated embodiment, the rotor segment 1 comprises a rotor element 1.1 which is essentially in the shape of a circular disc and concentrically surrounds the vertical machine axis and of an essentially ring-shaped or cylindrical rotor element 1.2 which likewise surrounds the vertical machine axis.

Distributed around the rotor element 1.2 at uniform angular intervals are filling elements 3, each of which, together with a bottle or container holder (not shown), in a known manner forms filling stations for the filling of the bottles 2 with the pourable product, and has at least one dispensing opening on its underside for this purpose.

Each filling element 3 is in communication via its own pourable product line 4 with its own connecting or discharge nozzle or socket 5 of an annular pourable product bowl 6 which surrounds the vertical machine axis and is filled to a specified level with the pourable product.

In the illustrated embodiment, the pourable product line 4 is composed essentially of two line segments, and in one possible embodiment first of the line segment 4.1, which extends through the rotor element 1.2, among other things, and makes the connection to a liquid duct that is realized in the respective filling element 3. The line segment 4.1 can thereby be realized in the form of a sleeve-shaped element, for example, and or in the form of a separate pipeline, whereby, for example, it can also be fastened to the rotor element 1.2 by screws, press-fitting or grouting.

The pourable product line 4 also comprises a line segment 4.2 which is detachably connected on its lower end in FIG. 1 by means of a coupling 4.3 with the line segment 4.1 and leads to the discharge sockets 5 in which the associated line end 4.4 is held. In the illustrated embodiment, in the line segment 4.2, a flow meter 7 in the form of a magnetically inductive flow meter (MID) is provided, and in one possible embodiment for the control of the associated filling element 3, and therefore also for the control of the filling process as a function of the quantity of pourable product delivered via the pourable product line 4.

The line segment 4.2 is fastened to a support strip 9 that runs radially with reference to the vertical machine axis by means of a fastening or support 8 which is realized in the form of a snap connection. For this purpose, the support strip 9 is provided with a recess 10 which is open on the side, in which the line segment 4.2 is inserted laterally, and which can be closed by a cover plate 12 which is provided with a corresponding recess 11. The support strip 9 and the cover plate 12 are fastened to the upper edge of the rotor segment 1.2 by means of a screw 13.

Also provided on the rotor segment 1 are two annular ducts 14 and 15, which also surround the vertical machine axis concentrically and are realized to carry media that are required and/or desired during the filling process, for example to carry gas and/or vapor media or a vacuum, i.e. the ring duct 14 can be, for example, a return gas or pressurization gas duct and the duct 15 is a relief duct which is in communication with the atmosphere or a vacuum duct, etc. These ring ducts 14 and 15 are in communication with controlled gas paths inside the filling elements 3 by means of duct segments 16 and 17 which are also formed partly by borings in the rotor element 1.2.

The ring duct 14 in the illustrated possible embodiment is formed by a special section ring or ring element 14.1 which is manufactured from a steel U-section and in one possible embodiment so that this section is in contact with its open side against the interior surface of the rotor element 1.2, where it is welded tightly to the rotor element 1.2, thereby forming the ring duct 14 so that it is closed by the ring element 14.1 and by the interior surface of the rotor element 1.2. The ring duct 15 in the illustrated possible embodiment is formed by a ring element 15.2 which is manufactured from a sheet steel angle section. The ring element 15.2 which also concentrically surrounds the vertical machine axis is inserted into the rotor segment 1 and welded to the rotor elements 1.1 and 1.2 so that in the vicinity of the corner between the rotor elements 1.1 and 1.2, the ring duct 15 which closed toward the outside by these rotor elements 1.1 and 1.2 and by the ring element 15.2 is formed.

The pourable product bowl 6 is held to the rotor segment 1 by means of a support structure at some distance above the rotor segment 1. The support structure is realized of cage work or an open work structure and comprises a plurality of support elements 18 which are distributed at regular angular intervals around the vertical axis of the machine. The support elements 18 are realized so that they have the smallest possible volume, although they are to a great extent identical or essentially identical in terms of shape, size and volume, i.e. they have the same dimensions and in the illustrated possible embodiment comprises a rectangular piece of sheet steel which is bent at a right angle on both its ends to form support element ends 18.1 and 18.2, so that each support element 18 forms a wide U-section. The exposed edges of the support element ends 18.1 and 18.2 are each directed radially outward with reference to the vertical axis of the machine. The support elements 18 are offset radially inward with reference to the pourable product lines 4 or the line segments 4.2 and the flow meters 7 provided in them with respect to the vertical axis of the machine, so that the space below the pourable product bowl 6 and thereby in one possible embodiment also the pourable product lines 4, the flowmeter 7, the supports 8 realized in the form of snap closures, etc. are easily accessible from the periphery of the rotor.

On the upper end 18.1 of each support element 18, the pourable product bowl 6 is fastened so that it rests on a respective support bracket 19. The lower support element end 18.2 is connected with the rotor element 1.1.

One possible feature of the realization described above is that the elements that are in contact with the pourable product or that carry the pourable product, namely including but not limited to the pourable product duct and liquid duct realized in the respective filling element 3, the valves in said duct that control the filling process, the pourable product line 4, the part or measurement duct of the flow meter 7 through which the pourable product flows, the pourable product bowl 6 and the connecting sockets 5 are made of a high-grade steel, for example stainless steel of Class 1.4404 or 1.4571, while the other elements that do not come into contact with the liquid pourable product, including but not limited to the elements that support the pourable product bowl 6 and the filling elements 3 as well as the elements that form the ring ducts 14 and 15, i.e. in one possible embodiment the rotor segment 1, the elements (support strip 9 and cover plate 12) that form the support 8, as well as the support elements 18 are fabricated from a lower-grade steel such as a steel in Class 1.4301, for example.

Stainless steel of Class 1.4404 (also known as Type 316L) or 1.4571 (also known as Type 316Ti) comprises molybdenum, which in sufficiently high amounts may help to provide resistance against pitting and/or corrosion. Additionally, stainless steel of Class 1.4571 (Type 316Ti) comprises titanium, which may further provide resistance against intergranular corrosion. In at least one possible embodiment of the present application, the surfaces which come into contact with the pourable product, i.e. a beverage, are made of stainless steel in Class 1.4404 (Type 316L). In at least one possible embodiment of the present application, the surface which come into contact with the pourable product, i.e. a beverage, are made of stainless steel in Class 1.4571 (Type 316Ti). These surfaces include, but are not limited to: the filling elements 3, product line 4, the part of the flow meter which comes into contact with the pourable product, the bowl or reservoir 6, and the connecting sockets 5. The compositions of stainless steels of Classes 1.4404 and 1.4571 are listed below:

| Stainless Steel Class | 1.4404/Type 316L |
|---|---|
| Carbon | 0.03 max |
| Manganese | 2.00 max |
| Phosphorous | 0.045 max |
| Sulfur | 0.03 max |
| Silicon | 0.75 max |
| Chromium | 16.00-18.00 |
| Nickel | 10.00-14.00 |
| Molybdenum | 2.00-3.00 |
| Nitrogen | 0.10 max |
| Iron | Balance |

| Stainless Steel Class | 1.4571/Type 316Ti |
|---|---|
| Chromium | 16.0-18.0 |
| Molybdenum | 2.00-3.00 |
| Nickel | 10.0-14.0 |
| Manganese | 2.00 max |
| Phosphorous | 0.045 max |
| Sulfur | 0.030 max |
| Silicon | 0.75 max |
| Carbon | 0.08 max |
| Nitrogen | 0.10 max |
| Titanium | 0.70 max |
| Iron | Balance |

Stainless steel in Class 1.4301 (also known as Type 304, often referred to as 18/8) neither comprises molybdenum nor titanium. This class or type of stainless steel is therefore more economical. In at least one possible embodiment of the present application, the surfaces of the filling machine which do not come into contact with the pourable product, i.e. a beverage, are made of stainless steel Class 1.4301/Type 304. These surfaces which do not come into contact with the pourable product include, but are not limited to: the support elements to the bowl 6 and the filling elements 3, the ring ducts 14 and 15, rotor or rotor segment 1, support strip 9, cover plate 12, support 8, and support elements 18. The composition of stainless steel Class 1.4301/Type 304 is listed below:

| Stainless Steel Class | 1.4301/Type 304 |
|---|---|
| Carbon | 0.08 max |
| Manganese | 2.0 |
| Silicon | 0.75 |
| Phosphorous | 0.045 |
| Sulfur | 0.03 |
| Chromium | 18-20 |
| Nickel | 10.5 |
| Nitrogen | 0.1 |
| Iron | Balance |

To achieve a uniform thermal expansion of the support elements 18 in the presence of varying temperatures in one possible embodiment, for example, of the type that occur in the filling machine between a cold condition and a hot bottling or a cleaning using a hot medium, and thereby in one possible embodiment to prevent, restrict, and/or minimize an inclined position of the pourable product bowl 6 caused by the temperature, the support elements 18 are not only fabricated from the same material but are also realized with the same shape and volume and with the lowest possible volume, so that any variations, in one possible embodiment variations of the distance between the support element ends 18.1 and 18.2 caused by temperature variations on the support elements 18, are as small as possible and are identical or essentially identical.

Because the elements that carry the pourable product or come in contact with them are fabricated from the higher-grade material and the elements of the rotor that do not carry the pourable product are fabricated from the lower-grade material, significant savings in manufacturing costs, among other things, can be achieved. Because it is essentially ensured or promoted that elements made of the lower-grade material do not come into contact with the pourable product, corrosion problems such as pitting, for example, can be effectively eliminated, restricted, and/or minimized.

To compensate for the different length variations between the various materials caused by temperature changes, in one possible embodiment the different variations in length between the support elements 18 and the pourable product line 4 caused by temperature variations, but also between the rotor element 1.2 and the pourable product line 4, and to prevent, restrict, and/or minimize stresses within the system that are caused by differential expansions when the various components are exposed to varying temperatures, the line segment 4.2 of the pourable product line 4 is held so that it can be displaced axially with its segment extending in the vertical direction in the support 8 and is axially movable on its upper, free end 4.4 in the vertical direction, but is located in a sealed manner in the discharge sockets 5 which are sealed by gaskets.

Because of the detachable connection between the line segments 4.1 and 4.2 and between the upper end 4.4 and the connecting sockets 5 and because of the support 8 which is realized in the form of a snap closure, in this possible embodiment, among other things, it is possible to easily replace the line segment 4.2 together with the flowmeter 7.

FIG. 3 shows, in a simplified illustration, a rotor segment 1*a* which differs from the rotor segment 1 essentially in that, in addition to the two ring ducts 14 and 15 which are formed by the ring elements 14.1 and 15.1 respectively, an additional ring duct 20 is provided, which is combined with the ring duct 15 into a stacked arrangement of ring ducts. The ring duct 20 is in turn formed by a ring element 20.1 which is fabricated from a steel angle section, and in one possible embodiment with a leg in the shape of a ring-shaped disc which concentrically surrounds the vertical machine axis and a leg in the shape of a circular cylinder which surrounds the vertical axis of the machine axis. On its exposed edges, the ring element 20.1 is welded to the rotor segment 1.1 and 1.2 respectively, so that the ring duct 20 bounded by the ring elements 15.1 and 20.1 and by the rotor elements 1.1 and 1.2 is formed. This ring duct 20 is also in communication with at least one controlled gas path which is realized in the respective filling element 3 by means of duct segments 21 which are formed at least partly by borings in the rotor segment 1.2. The ring duct 20 likewise does not serve as a duct for the liquid pourable product, but as a duct for a gas or vapor medium used during the filling process or for a vacuum. The ring element 20.1 is fabricated from a steel of a lower grade than the steel used for the elements that carry the pourable product.

FIG. 4 shows once again and very schematically a rotor or rotor segment 1*b* together with a support element 22 that supports the pourable product bowl 6. The support element 22, which is provided together with a plurality of identical or essentially identical support elements, is realized in the form of a pillar or rod and is connected with its lower end with the rotor segment 1*b* and with its upper end with one end of the support arm 23, which is held with its other end on the pourable product bowl 6. The support elements 22 have the same axial length and the same diameter, and are therefore identical or essentially identical with respect to size, shape, volume and the material used. In the event of temperature variations, there is a uniform thermal expansion for the support elements 22 and thus a uniform, temperature-dependent raising and lowering of the pourable product bowl 6 without any tilting or jamming of this bowl and/or of the connected pourable product lines with additional functional elements.

FIG. 4 also shows a ring line 24 which is formed by a ring element 24.1 which comprises a hollow section made of the lower-grade material or steel.

Figure 5:
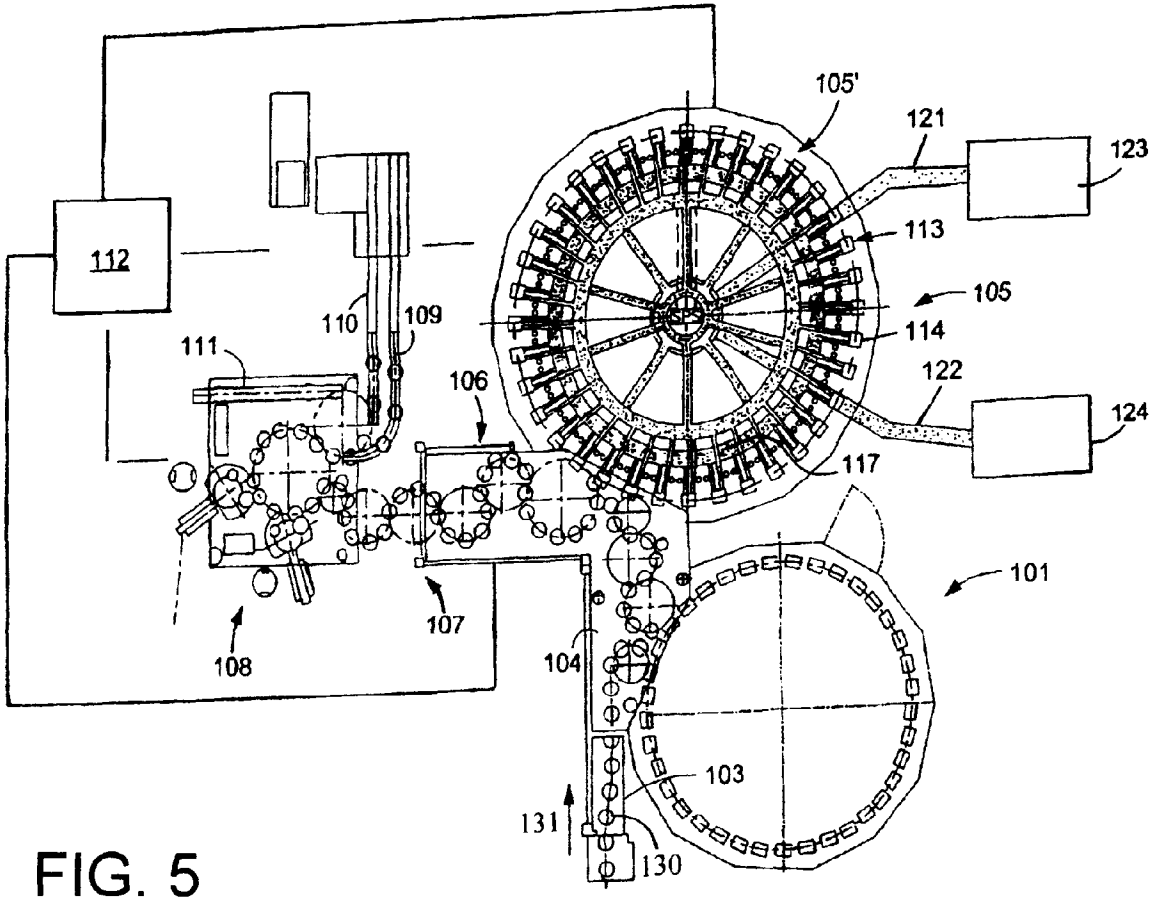
FIG. 5 PRIOR ART
FIG. 5 shows schematically the main components of one possible embodiment example of a system for filling containers, specifically, a beverage bottling plant for filling bottles with at least one liquid beverage, in accordance with at least one possible embodiment, in which system or plant could possibly be utilized at least one aspect, or several aspects, of the embodiments disclosed herein.

FIG. 5 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 5 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 5, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The present application was described above on the basis of possible embodiments. It goes without saying that numerous modifications and variants are possible without thereby going beyond the teaching of the present application.

For example, it is possible in one possible embodiment to fabricate the support elements 18 or 22 for the pourable product bowl 6 from a material or metal which has the lowest possible coefficient of thermal expansion, to thereby reduce temperature-dependent displacements of the pourable product bowl 6 relative to the respective rotor or rotor segment 1, 1*b* and other functional elements, in one possible embodiment including the pourable product lines 4.

One feature or aspect of an embodiment is believed at the time of the filing of this patent application to possibly reside broadly in a filling machine for the filling of bottles, cans, bags or similar containers 2 with liquid pourable product, with a plurality of filling elements 3 provided on a rotor or a rotor segment 1, 1*a*, 1*b* that can be driven in rotation around a vertical machine axis, whereby each filling element 3 has a dispensing opening for the controlled dispensing of the pourable product into the container 2 to be filled and is part of a pourable product path which is formed by the components that carry the pourable product, and which connects the respective dispensing opening with a pourable product bowl 6 which is provided on the rotor or rotor segment 1, 1*a*, 1*b*, wherein the surfaces of the pourable product path that come into contact with the pourable product between the pourable product bowl 6 and the dispensing opening are made of a material which is of a higher grade than the elements of the rotor or rotor segment 1, 1*a*, 1*b* that support the pourable product bowl 6 and the filling elements 3.

Another feature or aspect of an embodiment is believed at the time of the filing of this patent application to possibly reside broadly in the filling machine, wherein the pourable product bowl 6 is supported by means of a support structure on the rotor 1, 1*b*, and that the support structure is formed by a plurality of support elements 18, 22 which are distributed around the machine axis and are identical or essentially identical in terms of shape, volume and material.

Yet another feature or aspect of an embodiment is believed at the time of the filing of this patent application to possibly reside broadly in a filling machine for the filling of bottles, cans, bags or similar containers 2 with a liquid pourable product, with a plurality of filling elements 3 provided on a rotor or a rotor segment 1, 1*a*, 1*b* that can be driven in rotation around a vertical machine axis, whereby each filling element 3 has a dispensing opening for the controlled dispensing of the pourable product into the container 2 to be filled and is part of a pourable product path which is formed by the components that carry the pourable product, and which connects the respective dispensing opening with a pourable product bowl 6 which is supported on the rotor or rotor segment 1, 1*a*, 1*b* with a support structure, wherein the support structure is formed by a plurality of support elements 18, 22 which are distributed around the machine axis and are identical or essentially identical in terms of shape, volume and material.

Still another feature or aspect of an embodiment is believed at the time of the filing of this patent application to possibly reside broadly in the filling machine, wherein the surfaces of the pourable product path between the pourable product bowl 6 and the dispensing opening that come into contact with the pourable product are fabricated from a material which is of a higher grade than the elements of the rotor or rotor segment 1, 1*a*, 1*b* that support the pourable product bowl 6 and the filling elements 3.

A further feature or aspect of an embodiment is believed at the time of the filing of this patent application to possibly reside broadly in the filling machine, wherein the support elements 18, 22 are realized with a small volume.

Another feature or aspect of an embodiment is believed at the time of the filing of this patent application to possibly reside broadly in the filling machine, wherein the pourable product bowl 6 and [the] lines 4 that connect said bowl with the filling elements 3 are manufactured exclusively from the higher-grade material on their surfaces that come into contact with the pourable product.

Yet another feature or aspect of an embodiment is believed at the time of the filing of this patent application to possibly reside broadly in the filling machine, wherein liquid ducts realized in the filling elements 3 and having the respective dispensing openings are manufactured exclusively from the higher-grade material at least on their surfaces that come into contact with the pourable product.

Still another feature or aspect of an embodiment is believed at the time of the filing of this patent application to possibly reside broadly in the filling machine, wherein at least some of the components that carry the pourable product are manufactured entirely of the higher-grade material.

A further feature or aspect of an embodiment is believed at the time of the filing of this patent application to possibly reside broadly in the filling machine, wherein the higher-grade material is a high-grade steel such as stainless steel, for example, in one possible embodiment stainless steel in Class 1.4404 or 1.4571.

Another feature or aspect of an embodiment is believed at the time of the filing of this patent application to possibly reside broadly in the filling machine, wherein at least the rotor segment 1, 1*a*, 1*b* that supports the filling elements 3 and the pourable product bowl 6 and/or the support structure that supports the pourable product bowl 6 on the rotor or rotor segment 1, 1*a*, 1*b* are realized using a material which is of a lower grade than the material of the surfaces that come into contact with the pourable product.

Yet another feature or aspect of an embodiment is believed at the time of the filing of this patent application to possibly reside broadly in the filling machine, wherein on the rotor at least one ring duct 15, 16, 20 for a gas or vapor medium and/or vacuum is realized, and that this at least one ring duct 14, 15, 20, 24 is realized using a material which is of a lower grade than the material of the surfaces that come into contact with the pourable product.

Still another feature or aspect of an embodiment is believed at the time of the filing of this patent application to possibly reside broadly in the filling machine, wherein the one material which is of a lower grade than the material of the surfaces that come into contact with the pourable product is steel, such as a steel of grade 1.4301, for example.

A further feature or aspect of an embodiment is believed at the time of the filing of this patent application to possibly reside broadly in the filling machine, comprising means 4.4, 5 that allow a compensation of the lengths of the pourable product paths caused by temperature variations.

One feature or aspect of an embodiment is believed at the time of the filing of this patent application to possibly reside broadly in the filling machine, wherein each pourable product path is formed at least party by a pourable product line 4 that is connected to a connection pipe 5 of the pourable product bowl 6, and that the respective product line 4 is held in the connection socket 5 so that the connection is sealed for length equalization, although it can be displaced axially.

Another feature or aspect of an embodiment is believed at the time of the filing of this patent application to possibly reside broadly in the filling machine, wherein the support elements 18 are made of an Invar material.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the patents, patent applications or patent publications, which were cited in the International Search Report dated Oct. 28, 2008, and/or cited elsewhere are hereby incorporated by reference as if set forth in their entirety herein as follows: U.S. Pat. No. 4,559,961, having the title "SANITIZER SYSTEM FOR BEVERAGE CAN FILLER MACHINE," published on Dec. 24, 1985; DE 21 59 498, having the following German title "ABFUELLKOPF," published on Jun. 7, 1973; WO 99/43553, having the title "TWO CHAMBER FILLING TANK," published on Sep. 2, 1999; and DE 37 22 505, having the following English translation of the German title "FILLING MACHINE FOR VESSELS SUCH AS BOTTLES AND THE LIKE," published on Jan. 19, 1989.

The patents, patent applications, and patent publication listed above in the previous paragraph, beginning with the phrase: "All of the patents, patent applications or patent publications . . . " and ending with the phrase: " . . . published on Jan. 19, 1989," are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 049 963.8, filed on Oct. 24, 2006, having inventor Michael BEISEL, and DE-OS 10 2006 049 963.8 and DE-PS 10 2006 049 963.8, Federal Republic of Germany Patent Application No. 20 2006 016 208.9, filed on Oct. 24, 2006, having inventor Michael BEISEL, and DE-OS 20 2006 016 208.9 and DE-PS 20 2006 016 208.9, and International Application No. PCT/EP2007/008958, filed on Oct. 16, 2007, having WIPO Publication No. WO 2008/049535 and inventor Michael BEISEL, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/008958, German Patent Application 10 2006 049 963.8, and German Patent Application 20 2006 016 208.9 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/008958, DE 10 2006 049 963.8, and DE 20 2006 016 208.9 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1, 1*a*, 1*b* Rotor segment
1.1, 1.2 Rotor element
2 Bottle
3 Filling element
4 Pourable product line
4.1, 4.2 Line segment of the pourable product line
4.3 Detachable connection
4.4 End of the pourable product line
5 Connecting tubes
6 Pourable product bowl
7 Flowmeter
8 Support
9 Web
10 Recess
11 Recess
12 Cover plate
13 Bolt
14, 15 Ring duct
14.1, 15.1 Ring element
16, 17 Duct segment
18 Support element
19 Bracket
20 Ring duct
20.1 Ring element
21 Duct segment
22 Support element
23 Support arm

What is claimed is:

1. A filling machine for the filling of containers with liquid pourable product, said filling machine comprising:

a rotor arrangement being configured to be driven in rotation around a vertical machine axis;

a plurality of filling elements being disposed on said rotor arrangement;

each of said plurality of filling elements comprising a liquid duct configured to control flow of a pourable product into a container;

a pourable product bowl and a plurality of pourable product lines connecting said pourable product bowl to said filling elements;

said rotor arrangement comprising support components that support said pourable product bowl and support said filling elements;

said liquid ducts, said pourable product bowl, and said pourable product lines being made of a first material, and said support components being made of a second material;

said first material is more resistant than said second material to corrosion caused by a pourable product and/or filling machine cleaning materials passed through said liquid ducts, said pourable product bowl, and said pourable product lines;

said first material has a first coefficient of thermal expansion, and said second material has a second, different coefficient of thermal expansion; and at least one of said liquid ducts, said pourable product bowl, said pourable product lines, and said support components are configured to compensate for said different coefficients of thermal expansion.

2. The filling machine as recited in claim 1, wherein:

said support components comprises a plurality of elongated support elements that support said pourable product bowl; and said elongated support elements are distributed around said machine axis spaced apart from one another, and are essentially identical in shape, volume, and material.

3. The filling machine as recited in claim 2, wherein said first material is a stainless steel.

4. The filling machine as recited in claim 3, wherein:

said filling machine comprises at least one ring duct disposed on said rotor arrangement and configured to conduct a gas or vapor medium and/or vacuum; and said at least one ring duct comprises said second material.

5. The filling machine as recited in claim 4, wherein:

said pourable product bowl comprises a plurality of connection sockets;

each of said lines is connected to a corresponding one of said plurality of connection sockets; and each of said lines is held in its corresponding connection socket such that the connection is sealed and permits a relative displacement between said lines and said pourable product bowl to compensate for changes in at least one of length, size, and position of one of said lines and said pourable product bowl caused by temperature variations.

6. The filling machine as recited in claim 5, wherein said elongated support elements consist of an Invar material, said second material is stainless steel of grade 1.4301, and said first material is a stainless steel of grade 1.4404 or 1.4571.

7. The filling machine as recited in claim 2, wherein each of said elongated support elements has a minimized volume that is minimized in order to achieve an essentially uniform and minimal thermal expansion or contraction of said elongated support elements, to thereby essentially prevent an inclined position of said pourable product bowl caused by a change in temperature due to handling of a pourable product and/or filling machine cleaning materials of a substantially different temperature than the temperature of said elongated support elements.

8. The filling machine as recited in claim 2, wherein said elongated support elements comprise support brackets comprising an elongated center section and two end sections that are bent at an angle with respect to said center section.

9. The filling machine as recited in claim 1, wherein:

said pourable product bowl comprises a plurality of connection sockets;

each of said lines is connected to a corresponding one of said plurality of connection sockets; and each of said lines is held in its corresponding connection socket such that the connection is sealed and permits a relative displacement between said lines and said pourable product bowl to compensate for changes in at least one of length, size, and position of one of said lines and said pourable product bowl caused by temperature variations.

10. The filling machine as recited in claim 1, wherein:

said filling machine comprises at least one ring duct disposed on said rotor arrangement and configured to conduct a gas or vapor medium and/or vacuum; and said at least one ring duct comprises said second material.

11. The filling machine as recited in claim 10, wherein said first material is stainless steel of grade 1.4404 or 1.4571.

12. The filling machine as recited in claim 11, wherein said second material is one of: an Invar material or a steel of grade 1.4301.

13. The filling machine as recited in claim 1, wherein each of said lines comprises a removable pipe section which is detachably connected to said pourable product bowl by a connection socket in said pourable product bowl, and detachably connected to said rotor arrangement by a support structure.

* * * * *